United States Patent [19]

Clark

[11] Patent Number: 4,752,919

[45] Date of Patent: Jun. 21, 1988

[54] CLOCK WITH DIGITAL HOUR STATION AND LINE OF DISCRETE, BINARY MINUTE SUBSTATIONS

[76] Inventor: Lloyd D. Clark, 15 Conrad St., San Francisco, Calif. 94131

[21] Appl. No.: 815,941

[22] Filed: Jan. 3, 1986

[51] Int. Cl.[4] ..... G04B 19/00

[52] U.S. Cl. ..... 368/223; 368/241; 368/242; 368/82; 368/83

[58] Field of Search ..... 368/232, 231, 223–229, 368/239–242, 76, 82, 83, 84

[56] References Cited

U.S. PATENT DOCUMENTS

| | | | |
|---|---|---|---|
| 2,221,413 | 11/1940 | Schanz . | |
| 2,333,832 | 11/1941 | Torroja . | |
| 3,574,992 | 4/1971 | Ladas | 58/50 |
| 3,956,879 | 5/1976 | Bailey | 58/2 |
| 4,103,484 | 8/1978 | Bailey | 58/125 C |
| 4,161,098 | 7/1979 | Ingendahl | 58/2 |
| 4,270,196 | 5/1981 | Terzian | 368/82 |
| 4,271,497 | 6/1981 | Terzian | 368/82 |
| 4,357,691 | 11/1982 | Goodchild | 368/62 |
| 4,483,628 | 11/1984 | Terzian | 368/82 |

FOREIGN PATENT DOCUMENTS

| | | | |
|---|---|---|---|
| 281339 | 12/1964 | Netherlands | 368/232 |

*Primary Examiner*—Bernard Roskoski
*Attorney, Agent, or Firm*—David Pressman

[57] ABSTRACT

The time of day is displayed on clock face (10) through the use of two, two-digit numerical stations (20) and (30) and a minutes scale comprised of marks (40). The left-hand station (20) indicates the actual hour of the day and the right-hand station (30) indicates the next hour of the day so that display (30) always indicates one hour past the time shown by display (20). A series of lamps (40) between the two stations are used to form a bar-graph display of the minutes of the hour. A number of display modalities are possible. Electronic and mechanical versions of the timepiece are shown.

20 Claims, 7 Drawing Sheets

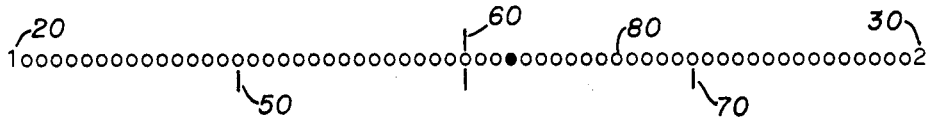
Fig. 2a. 1:33 o'clock
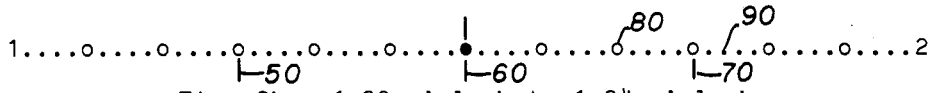
Fig. 2b. 1:30 o'clock to 1:34 o'clock
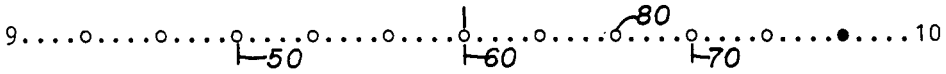
Fig. 2c. 9:55 to 9:59 o'clock
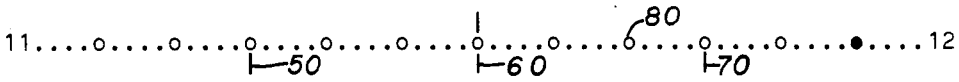
Fig. 2d. 11:55 to 11:59 o'clock
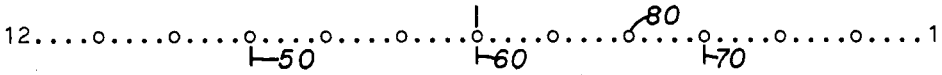
Fig. 2e. 12:00 to 12:04 o'clock
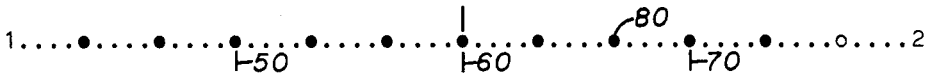
Fig. 2f. An alternate display modality at 1:50 o'clock

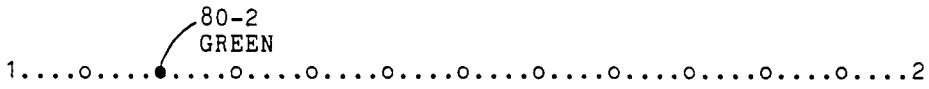
Fig. 3a. 1:10 to 1:12 o'clock
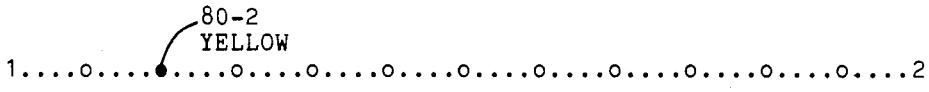
Fig. 3b. 1:12 to 1:14 o'clock
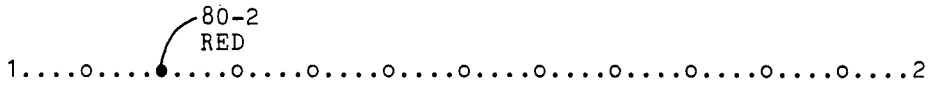
Fig. 3c. 1:14 to 1:15 o'clock
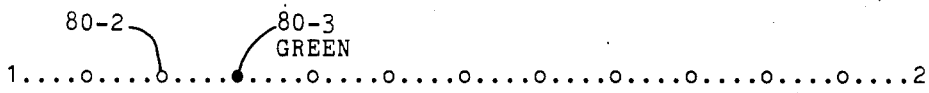
Fig. 3d. 1:15 o'clock

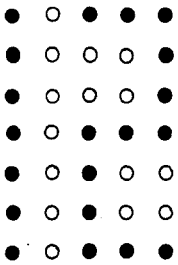
6A.
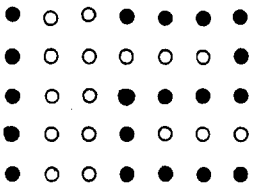
6B.
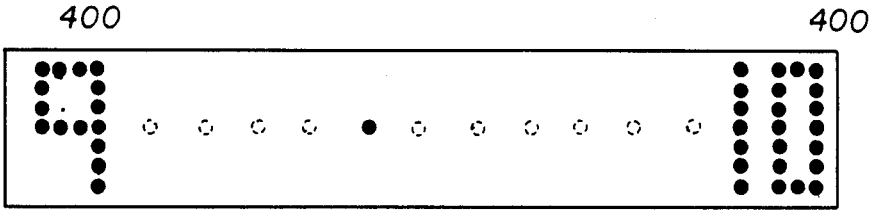
6C. 9:25 O'CLOCK
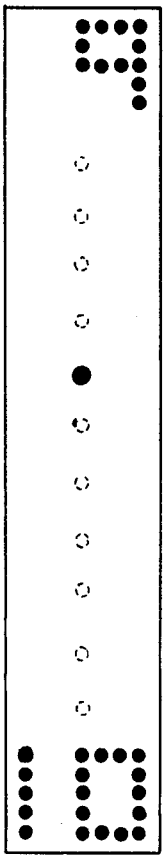
6D. 9:25 O'CLOCK
FIGS. 6.

CLOCK WITH DIGITAL HOUR STATION AND LINE OF DISCRETE, BINARY MINUTE SUBSTATIONS

BACKGROUND

1. Field of Invention:

This invention relates to horology, particularly to a novel means for indicating the time of day.

2. Prior Art:

Analog Timepieces

Timepieces with moving hands, known as analog timepieces, have been used for centuries and are well known. Modifications of this basic concept have been made from time to time. An example of such a modification is taught by J. R. Bailey, U.S. Pat. No. 3,956,879, 1976. Bailey employs a series of endless belts with indicators affixed to each belt. The indicators move with their associated belts in a fashion representative of the time and are viewed through a faceplate. The faceplate is inscribed with time indications (i.e. month, day, hour, minute, second, etc.). The time is determined by noting the positions of the belt-indicia as they move in their respective slots adjacent to the time indications on the faceplate. (In a later patent, U.S. Pat. No. 4,103,484, 1978, Bailey describes another mechanism for moving his time-indicating indicia.)

At its simplest, the face of Bailey's clock, (FIG. 13) shows a series of thirteen numbers (12, 1, 2, . . . 12, with indicators for the quarter-hours. At its most complex (FIGS. 23 and 24), Bailey's clock offers a bewildering and unaesthetic array of days of the week, hours, minutes, and seconds, each of which is accompanied by its appropriate subdivisions, e.g., 60-second markers with numerical indicia at 0, 10, . . . ; 60-minute markers with numerical indicia at 0, 10, . . . , and so forth. Thus the user will find it difficult to tell the time from Bailey's relatively complicated clock face.

Another departure from the ordinary circular clock face is taught by J. M. Torroja in U.S. Pat. No. 2,333,832, 1943. Torroja's clock employs a faceplate with the numbers corresponding to the hours and the minutes printed in straight lines. Pointers reach around the faceplate from behind and move along the rows of numbers to indicate the hours and minutes. In a fashion similar to Bailey and Schanz (below), Torroja shows a clock face in which the thirteen numbers, 12 and 1 through 12, are presented on the front of the clock for the user along with the possibility of a second row of seven numbers for the seconds. Because of the large array of constantly-displayed numbers, the user will find Torroja's clock face relatively complex and hence difficult to use. Also Torroja's clock face is visually prosaic.

J. L. Schanz, in U.S. Pat. No. 2,221,413, 1940, teaches a "straight-line" clock with moving indicators. In appearance this timepiece is similar to the simplest of Bailey's versions (cf. Schanz, FIG. 1, with Bailey, FIGS. 13 and 14) and to Torroja's FIG. 1. Schanz'clock suffers from the same disadvantages as Bailey's and Torroja's. All of them require more than casual study, certainly more than a glance, in order to tell the time.

J. Goodchild, in U.S. Pat. No. 4,357,691, 1982, uses two moving orthogonally-oriented lines. One line has numbers indicative of minutes, the other has numbers indicative of hours. As the lines move with respect to one another, their intersection moves. The number at the intersection of the lines indicates the time. Insofar as Goodchild's clock indicates the time by the intersection of the two lines mentioned above, it is an "area" clock as opposed to a "linear" clock. Because two axes are required to display the time (one for hours, one for minutes) Goodchild's clock occupies significantly more space than a one-dimensional "linear" clock.

K. Ingendahl, in U.S. Pat. No. 4,161,098, 1979, teaches a device for telling the time which is not appropriate for use as a primary timepiece. His invention is an object d'art. It is difficult or impossible for one, on seeing this object for the first time, to realize, without further instruction, (1) that it is a clock, and (2) to determine the correct time.

G. T. Ladas, in U.S. Pat. No. 3,574,992, 1971, teaches a timepiece which aims to imitate the minimalism (simplicity) in architecture and interior design. It involves a reduction in visible detail, including all numerical indicia on the surface of the clock. Ladas' clock employs an assembly of lighted rectangles. The rectangles are lit in sequence according to the time. (FIGS. 1, 2, and 4.) Ladas concedes that the "novel display in accordance with the invention entails some degree of reconditioning in reading time" and that the time-display "though perhaps mysterious to the uninitiated, is perfectly clear and aesthetically satisfying to the knowledgeable owner." This exercise in abstract design is, like Ingendahl's clock, a work of art. It is not appropriate as a primary timepiece, and has the same difficulties as the most complicated of Bailey's designs, though for the opposite reason, the absence of detail.

3. Prior Art:

Digital Timepieces

Timepieces which indicate the time by means of changing digits, usually in Arabic numerals, are also well known, but suffer from a number of serious disadvantages.

In U.S. Pat. No. 4,270,196, 1981, B. A. Terzian presents (FIG. 1) what he calls "balanced complementary digital time displays." This is a method of telling the time in which multiple digital displays are used to indicate the time. A principal minutes display indicates the passage of the minutes of the hour. Simultaneously, a second minutes display indicates complementary minute digit values which decrease as time advances. Terzian's design is complex and not easily read. More attention has been given in the development of his clock to the prominent display of the number of minutes elapsed or remaining in the current hour or to the display of the following hour than to establishing the current hour itself.

This same tendency is shown in the clock of Terzian's U.S. Pat. No. 4,271,497, 1981, FIGS. 4 and 5. The time represented on the clock faces in these figures are 9:42 and 9:54. With practice, one could learn to read the time from Terzian's inventions as described in these two patents, but the potential for error would be extremely high. It would not be easy to read the time from these clocks at a glance as one might normally wish to do throughout the course of a day.

Identical difficulties are encountered in the clock of Terzian's U.S. Pat. No. 4,483,628, 1984. See in particular FIG. 3.

OBJECTS AND ADVANTAGES

According one principal object and advantage of my invention is to provide a timepiece which combines the best features of linear clock displays with those of their digital counterparts, thus improving the legibility of the one and increasing the utility of the other. Another object is to create a primary timepiece with a clearly contemporary design, employing electronic and mechanical capabilities currently available in such a way that a minimal amount of information is presented to the user.

Further objects and advantages of my invention are to simplify the face of a clock, thereby achieving an aesthetically pleasing clockface, and to provide a clockface with increased legibility, with only the information which the user needs present on the face of the clock. Further objects and advantages will become apparent from a consideration of the ensuing description and accompanying drawings.

DRAWINGS

In the drawings, which are not to scale:

FIG. 1 shows an electronic version of a clock face according to the present invention.

FIGS. 2*a* through 2*f* show clock face at various times of the day.

FIG. 3 shows the operation of a timepiece, according to the present invention, which employs bi-color LED lamps for the five-minute indication marks between hour indicators.

FIGS. 6A–6D show a variation on the clock face which permits the clock to be viewed in either a horizontal or a vertical orientation.

DRAWING REFERENCE NUMERALS

10 Clock Face
20 Numerical Display
30 Numerical Display
40 Lamps
50 Fiducial Line
60 Fiducial Line
70 Fiducial Line
80 Light-Emitting Diode (LED) or Lamp
90 Dots (1-minute marks)
200 Read-Only Memory (ROM)
210 Microprocessor
220 Input Terminal
230 Resistor
240 Capacitor
250 Interrupt Input (to Microprocessor)
260 Octal Latch
270 Display Driver
280 Decoder
290 Resistor
300 Resistor
310 Display
320 Display
330 Display
340 Display
360 Clock (Oscillator) Circuit
370 Switch
380 Resistor
390 Resistor
400 Dot Matrix Display
500 Numbered Wheel
510 Numbered Wheel
520 Viewing Window
530 Sliding Indicator
540 Minute Indicators

FIG. 1—BASIC CLOCK DISPLAY, ELECTRONIC VERSION

Figure 1:
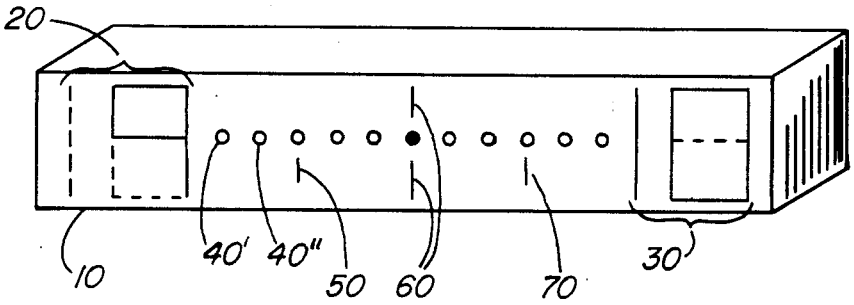

FIG. 1 illustrates the basic principle of a timepiece according to the present invention. Clock face 10 consists of two numerical display stations 20 and 30, each of which can present any number from 1 to 12. For purposes of illustration, left station 20 is displaying a "9" and right station 30 a "10".

Each one-segment station can display either or both of two digits, the left digit being a one-segment "1", which can be either on or off, and the right digit being a typical seven-segment matrix "8" which can display any digit from 0 to 9 by selectively turning on the segments. The "off" segments in stations 20 and 30 are indicated in broken lines. A 24-hour display can easily be implemented by changing the left halves of stations 20 and 30 so that they can display a "2" as well as a "1".

Stations 20 and 30 are separated by a linear series of substations, each represented by one of a series of lamps 40. The lamps may be illuminated individually. Each lamp preferably consists of a single light-emitting diode, but other types of lamps, such as incandescent, plasma, neon, etc. can be used. Also, non-light-emitting markers, such as solenoid-controlled markers, piezoelectric markers, liquid crystal markers, etc., can be employed. While 59 lamps could be used, representative of each minute of the hour, to save cost and space, only eleven lamps might be used, as shown for purposes of facilitation of explanation. These lamps correspond to five-minute intervals, e.g. 5, 10, 15, . . . minutes after the hour.

Thus stations 20 and 30 indicate a digital number corresponding to the number of major time intervals (hours) which have elapsed from a given time, while substations 40 indicate (in binary form) the number of subdivisions of the major time interval which have elapsed since the time indicated by the left station.

In FIG. 1, the timepiece indicates 9:30 o'clock. It is read as follows: On the left side of the clock face, station 20 indicates a "9" (for 9 o'clock) since its "1" is "OFF" or blank, and its right (matrix) digit reads "9". At station 30, both the "1" and the "0" of digits 30 are "ON", indicating 10 o'clock. Station 30 always indicates one hour later than station 20. Since the sixth five-minute lamp 40 is lit, the minutes are $6\times5$ or 30, thus indicating the time is 30 minutes past the 9 o'clock hour, as also indicated by the fact that a lamp 40 physically half way between the 9 and 10 is lit. If no lamp 40 is lit, then the time of day lies between 9:00 and 9:05.

Lamps 40 thus serve to indicate the passage of time between digits 20 and 30. They are illuminated in sequence, starting with the lamp closest to "hour" indication 20 and then proceeding to "hour+1" station 30. Thus, at 9:05 o'clock, the first lamp (40') to the right of station 20 would be lit, or "ON", and all other lamps 40 would be dark or "OFF". This lamp will remain "ON" until the time reaches 9:10. At 9:10 o'clock, the second lamp (40'') would be lit, and all other lamps would be dark or "OFF".

This progression continues across face 10 of the timepiece until 10:00 o'clock. At 10:00 o'clock, station 20 will change from a "9" to a "10" and station 30 from a "10" to "11" and all lamps 40 will be "OFF". The same progression of lamps 40 will indicate the passage of time between 10:00 and 11:00, and similarly for all other hours of the day. (At noon or midnight, station 20 will indicate a "12" and station 30 a "1".)

Vertical fiducial lines 50, 60, and 70 may be added to face 10 for improved readability. These lines identify the "15", "30" and "45" minute lamps 40, respectively. At five minutes past the hour, when lamp 40' is "ON", and all other lamps are off and thus nonvisible, it is possible to determine at a glance that the correct time is 5 minutes past the hour (rather than 10 or 15 minutes past) because illuminated lamp 40' is closer to station 20 than to 15-minute line 50. At 10 minutes past the hour when lamp 40'' is "ON", and all other lamps are off, it is possible to determine at a glance that the correct time is 10 minutes past the hour because illuminated lamp 40'' is halfway between station 20 and 15-minute line 50. And so forth across face 10 of the clock.

FIGS. 2—BASIC TIMEPIECE READOUT AT VARIOUS TIMES OF DAY

The appearance of the clock face at various other times of the day is shown in these figures.

Each of the small circles 80 in FIG. *2a* represents a light-emitting diode (LED). The open circles represent LEDs which are "OFF", or dark. The filled circle represents an LED which is "ON". Each LED represents one minute of the hour. The use of 59 LEDs permits determination of the time to the nearest minute. In many applications, this may be a desirable embodiment of the present invention.

In the interest of brevity, ease of use, and lowering production cost however, I feel that the abridged, 5-minute displays of FIGS. 1 and *2b* through *2e* are adequate. As in FIG. *2a* above, circles 80 represent LEDs. Between each adjacent pair of LEDs are four marks or dots 90, which represent minute positions. Dots 90 may be simply printed on the clock face.

As with FIG. 1, in FIG. 2 right station 30 always displays one hour higher than left station 30. As before, both stations advance from "1" through "12" and then repeat. Thus my clock shows the hour, the number of minutes after the hour and the relative time between the two hours at either extreme of the display. In this way, I have combined the best features of an ordinary digital time display and a linear clock.

A variation on the manner of presentation described in connection with FIGS. *2a* through *2e* is shown is FIG. *2f*. Rather than lighting only one lamp 80 for each 5-minute interval, all lamps, once lit, would remain "ON" until the time reaches the next hour. This variation forms a "bar-graph" display of the time passing from one hour to the next. On the hour, hour count indicators 20 and 30 would be increased by one and all lamps 80 extinguished in preparation for displaying the passage of time through the new hour. FIG. *2f* shows clock face 10 at 1:50 to 1:54 o'clock with this feature engaged.

Upon consideration of this design the reader may realize that right station 30 is redundant and may be eliminated with no loss of information. It is included in FIG. *2f* for aesthetic balance.

FIGS. 3—READOUT USING VARIABLE-COLOR LEDs

A variation of the above scheme is shown in FIGS. 3. Here each minute station consists of a variable-color LED 80, i.e. a lamp with two adjacent LEDs in one package where one of the LEDs is red, the other is green. By varying either the relative magnitude of the current through the two diodes, or by time-multiplexing their excitation current, it is possible to attain any color of the visible spectrum which lies between these two colors. For example, lighting only the red LED of the pair yields a red output. Lighting only the green yields a green output. Lighting both the red and the green with roughly the same excitation currents (or time-multiplexing the excitation current equally between the two diodes) will yield a yellow output, etc. One such dual LED lamp is model MV5491, manufactured by General Instrument Company, Optoelectronics Division, 3400 Hillview Ave., Palo Alto, Calif. 94304.

According to this embodiment, the appearance of any lamp 80 is made green for the first two minutes of each 5-minute interval, yellow for the second two minutes of the interval, and red during the last minute of each interval. Thus, as shown in FIG. *3a*, at 1:10 o'clock the second LED 80-2 turns on and is made to emit green light. At 1:12 (FIG. *3b*) it emits yellow, and at 1:14 (FIG. *3c*) it emits red. At 1:15 the third LED, 80-3, is turned on and emits green until 1:17, etc. By using variable-color LEDs in this manner, it is possible to improve the accuracy of the timepiece and enhance its appearance while still keeping the parts count to a minimum.

FIG. 4—ELECTRONIC CIRCUIT DIAGRAM

Figure 4:
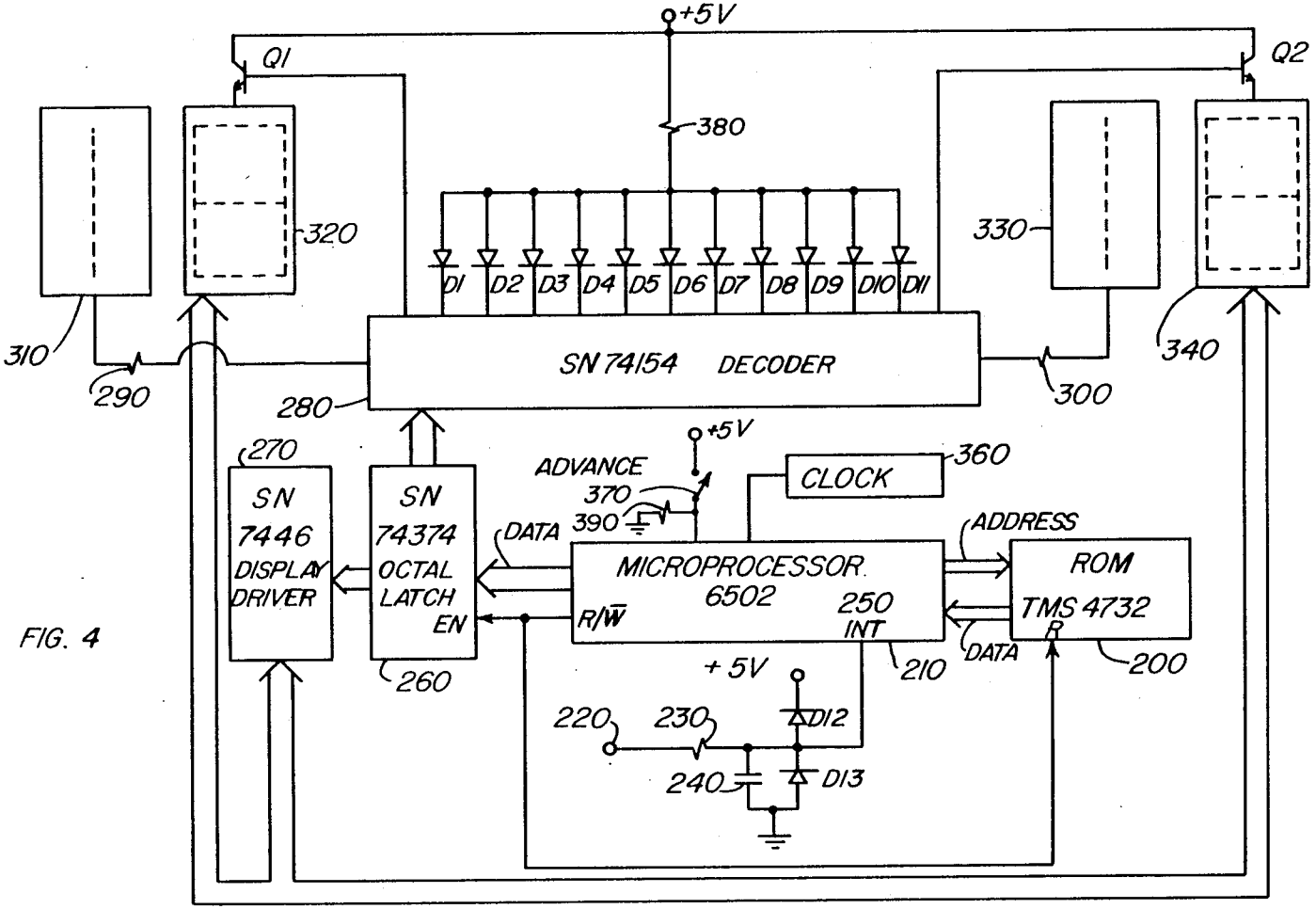
FIG. 4 shows a schematic diagram of electronic circuitry utilized in one preferred embodiment of the electronic version of the present invention.

FIG. 4 shows an electronic circuit which will display the time of day in the manner shown in FIGS. 2 according to the principles of the present invention. The circuit consists of a type 6502 microprocessor 210, such as that manufactured by Synertek Inc., 3001 Stender Way, Santa Clara, Calif. 95054, a type SN74154 4-line-to-16-line decoder 280, a SN7446A seven-segment LED display driver 270, a type TMS4732 read-only memory (ROM) 200, and a type SN74LS374 octal latch 260, manufactured by Texas Instruments, Inc., P.O. Box 5012, Dallas, Tex. 75222. The circuit also contains displays 310 and 330; these are single-digit "overflow" (i.e. either a "1" or "blank") LED displays such as type HDSP-7307. It also has displays 320 and 340, which are seven-segment LED displays such as type HDSP-7301. Lastly, it has LEDs D1 through D11; these are type HLMP-4700, all manufactured by Hewlett-Packard Corporation, 1501 Page Mill Road, Palo Alto, Calif., 94306.

ROM 200 contains the program instructions and data required for operation of the timepiece. A logic flow diagram which depicts the various instructions programmed into ROM 200 is shown in FIG. 5. An alternating current signal from the power mains provides timing information. In most countries this is a 50- or 60-Hertz sine wave. A step-down transformer (not shown) reduces the voltage from the mains to about 5 volts, root-mean-square (RMS). This voltage is applied between terminal 220 and ground. A resistor (R) 230 limits the current flowing into diodes D12 and D13 which are connected in series from a +5 volt DC source to ground and whose junction is connected to the right side of R 230. A typical value for resistor 230 is 1,000 ohms. A capacitor 240, also connected between R 230 and ground in parallel with D12, acts in concert with resistor 230 to form a low-pass filter. A typical value for capacitor 240 is 0.1 microfarad. This r-c filter removes power line transients which will cause extra, unwanted input signals to be applied to interrupt input 250 (pin number 4) of microprocessor 210. Diodes D12 and D13 act as a clipper to provide a rough square-wave input to interrupt input 250. A square-wave is required at this input to ensure reliable operation of microprocessor 210. The reason for the application of the square-wave signal to interrupt input 250 is discussed below in connection with FIG. 5. The 5-volt RMS voltage present at terminal 220 is also rectified and filtered (circuit not shown) and used as the power source for all the circuit elements shown in FIG. 4.

Microprocessor 210 is driven at its pin number 37 at a high frequency by a "clock" oscillator circuit 360. A typical clock frequency for a microprocessor is several megahertz. This makes possible many logical operations per second.

Under instructions from ROM 200, microprocessor 210 periodically applies signals from its data pins (pin numbers 26 through 33) and Read/Write pin (pin number 34) to octal latch 260 (data pins 3, 4, 7, 8, 13, 14, 17 and 18, and clock pin 11). These signals are "latched" on the outputs (pins 2, 5, 6, 9, 12, 15, 16 and 19) of buffer 260. Four of the outputs of buffer 260 are connected to seven-segment LED display driver 270. These four lines contain binary-coded decimal data. This information is decoded for application to either of the seven-segment LED displays 320 or 340. The other four outputs of buffer 260 are connected to 4 line-to-16-line decoder 280. Decoder 280 can apply a logical "1" (or +5 volts) to displays 310 or 220, to npn transistors Q1 or Q2 and to any one of diodes D1 through D11. When decoder 280 applies a logical "1" to transistor Q1, display 320 is activated. Any data present at the output of driver 270 will be read out by display 320. Similarly, a coincidence of signals at transistor Q2 and driver 270 will cause the data present at the output of driver 270 to be shown by display 340. Resistors 290 and 300 limit the current through displays 310 and 330. These resistors would typically have a value of 150 ohms.

Microprocessor 210 outputs data through octal latch 260 in a sequential fashion. Displays 320 and 340 are activated (illuminated) alternately. Data bits corresponding to the number to be shown by display 320 are presented to the inputs of driver 270. At the same time, data which will activate output 310 of decoder 280 are presented to the four input lines of decoder 280, thus activating transistor Q1 thereby causing display 320 to show the appropriate number.

Next, a new set of signals is supplied from microprocessor 210 to latch 260. The new signals cause display 340 to show the appropriate number in the same manner as described above for display 320. Thereafter, a further set of signals is applied to buffer 260. These cause display 310 to be activated, if appropriate according to the hour to be displayed. Next, another set of signals will cause display 330 to be illuminated if appropriate. Finally, a new set of signals will cause one of diodes D1 through D11 to be illuminated, to signal the correct 5-minute interval of the hour. This process repeats many times per second to give the illusion that all elements of the display are illuminated continuously.

Resistor 380 limits the current flowing through whichever LED (D1 through D11) is lit. Resistor 390 is a "pull-down" resistor which holds the "advance" input to microprocessor 210 at logic "0" when advance switch 370 is "open".

FIG. 5—LOGIC FLOW DIAGRAM

The operational sequence of the timepiece may be broken into two separately functioning parts: the display function and the timekeeping function. The display function runs continuously except when an interrupt signal is supplied to the interrupt input of microprocessor 210 (FIG. 4). Interrupts occur 60 times per second in the present example.

When power is first applied to the timepiece, a "power-on" reset sequence occurs to initialize the operating parameters. This sequence occurs only once when the power is applied. The programming then proceeds to the display function. The display function continues until an interrupt occurs. At the end of the interrupt routine, the display function resumes.

Figure 5A:
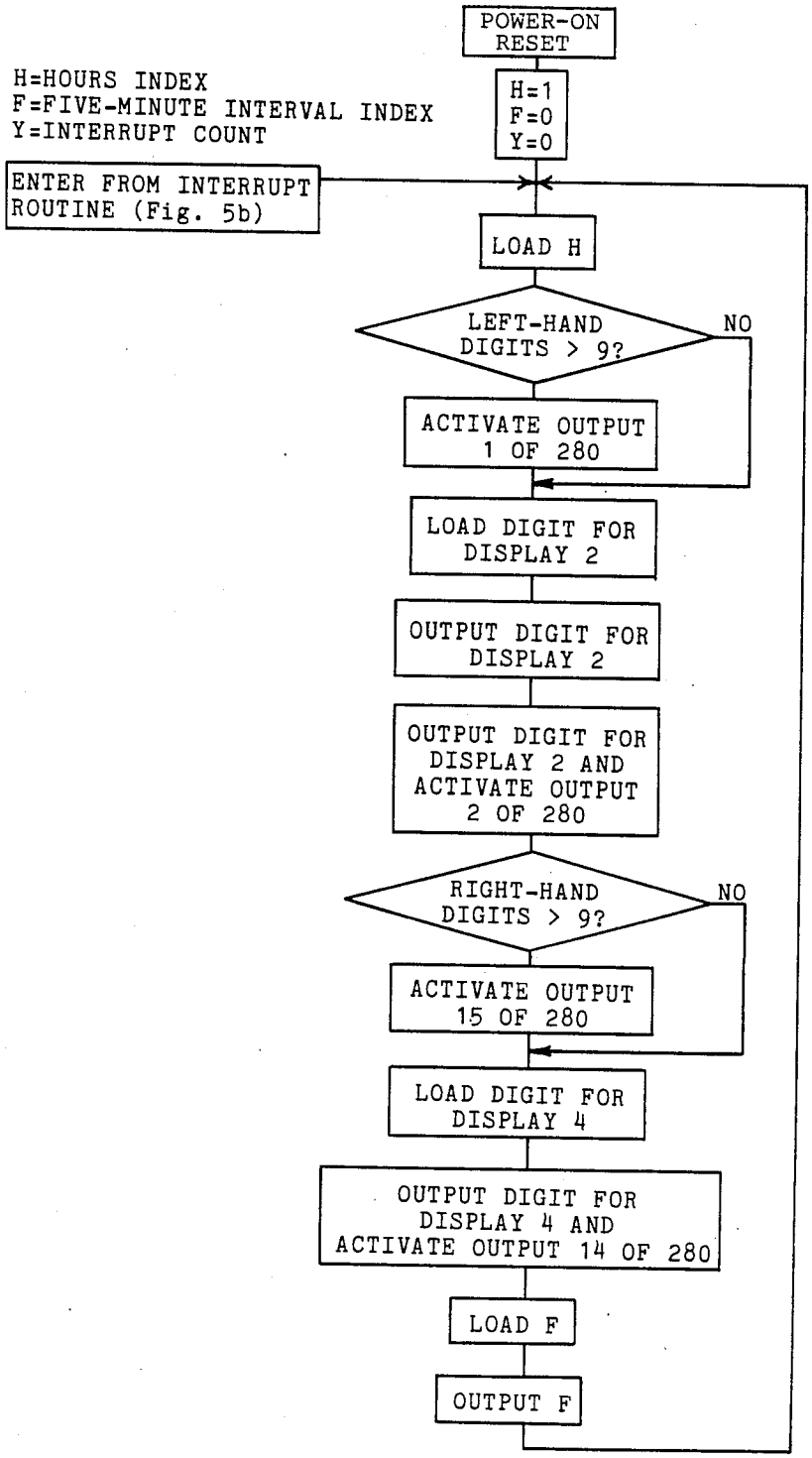
FIGS. 5A, 5B are a logic flow diagram of the timekeeping and display sequences employed in the electronic version of the invention.

Refer to FIG. 5*a*. (The logic function sequence moves from top to bottom in FIGS. 5*a* and 5*b*.) The parameters important to operation of the timepiece are: H, the hours index, F, the five minute interval index, and Y, the interrupt count index. When power is applied to the circuit, a standard hardware reset function (not shown) is employed to initialize the various operating parameters; thus H, F and Y are set to zero. The left half of station 20, display 310, is addressed first. If the left station is to display an hour greater than 9, the leftmost digit will be "1". Since the clock has just been started, the leftmost digit will be a zero, or blank. The microprocessor then loads the digit for display 320, supplies it to display driver 270, and applies a 5-volt signal to the base of transistor Q1. This causes a "1" to be shown by display 320. The two digits of righthand station 30 are next addressed in the same fashion. Next, the F index is loaded. Since F is equal to zero at this point, the output to decoder 280 (FIG. 4) will be zero. At this point, the display loop repeats.

Figure 5B:
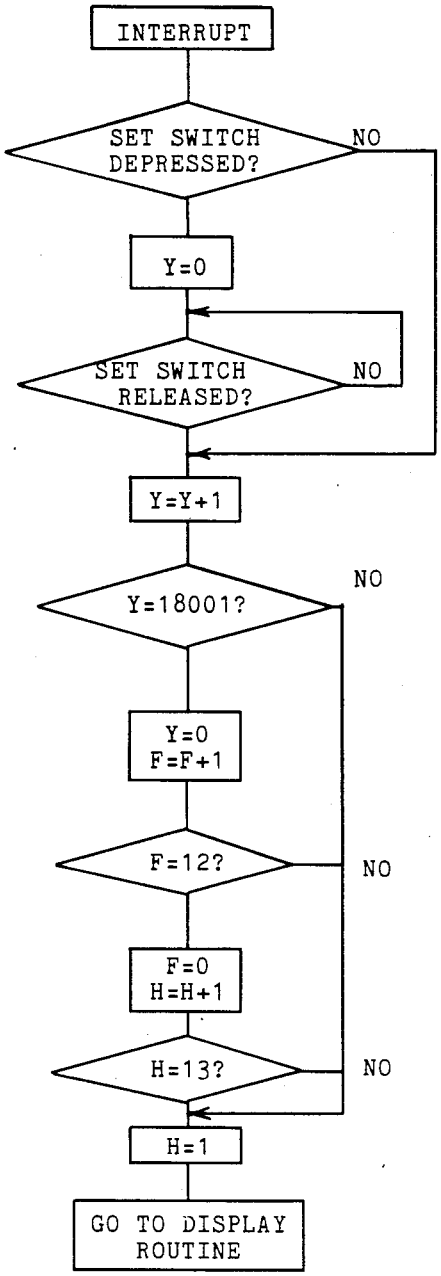

The interrupt loop, shown in FIG. 5*b*, has priority over the display loop. Each time an interrupt signal is received at input 250 of microprocessor 210, the display sequence is interrupted and the program moves to the top of the interrupt loop. The interrupt loop is used to detect the presence of a "set" signal. When the user wishes to set the time, he or she closes "set switch" 370 (FIG. 4). The closing of this switch signals microprocessor 210 to advance F, the five-minute interval index count, by 1. The time of day displayed is thus advanced in five-minute steps until the correct time is displayed.

A circuit which will implement the logic steps of FIG. 5 is shown schematically in FIG. 4. The components (integrated circuits, LEDs, etc.) of this circuit would preferably be arranged on a printed-circuit board. The organization of this arrangement is not critical and would be dictated by the aesthetics of the case design used in the timekeeping product.

FIG. 6—ROTATED DISPLAY

One further variation on the timepiece design according to this invention is shown in FIG. 6. In this version, indicators 20 and 30 (FIG. 1) are replaced by two 5 dot by 7-dot alphanumeric displays. One such display is part number MAN29, manufactured by General Instrument, Optoelectronics Division, 3400 Hillview Avenue, Palo Alto, Calif. 94304. Each of the dots in these displays contains one light-emitting diode. The LEDs can be illuminated in any combination to display one or more characters of any shape which can be fit into the 5×7 array. FIG. 6a shows the number "12" displayed by a 5×7 dot matrix display. The filled-in circles represent "ON" or illuminated dots, the open circles represent "OFF" or blank positions in the display.

If the display in FIG. 6a is rotated 90-degrees, different dots can be illuminated to produce the same numerical readout. This is shown in FIG. 6b.

By adding a switch to the clock circuitry, the user can cause the 5×7 dot matrix displays to display numbers normally, as in FIG. 6a or rotated 90-degrees (180-degrees is also possible), as in FIG. 6b. Thus the timepiece can be used either horizontally as shown in FIG. 6c, or vertically as shown in FIG. 6d. In the case shown in FIG. 6d, the lighting of the 5-minute increment dots moves from top to bottom. If desired, the clock could be rotated 180-degrees so that the 9 is at the bottom, the 10 is at the top, and 5-minute LEDs are lit sequentially from bottom to top. A mercury, or other type of tilt switch (not shown) could be employed within the clock so the switching from horizontal to vertical modes would be automatic.

FIG. 7—A MECHANICAL VERSION OF THE TIMEPIECE

Figure 7:
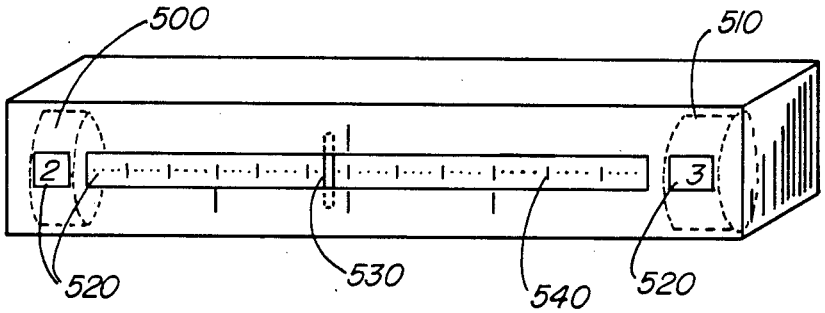
FIG. 7 shows a phanton view of the face and mechanism in a mechanical version of a clock according to the present invention.

FIG. 7 shows a phantom view of a mechanical version of the timepiece. Two numbered wheels 500 and 510 are provided which contain the numbers "1" through "12" (for a 12-hour clock). The two rotating wheels are connected together by a common shaft so that wheel 510 on the right always indicates one hour greater than wheel 500 on the left. A sliding indicator 530, much like a radio dial, moves across the clock face each hour in a manner similar to that described above. Minute indicatations 540 are printed on viewing window 520 through which the wheels and the sliding indicator are viewed. A motor and electronic circuit (not shown) provide the mechanical drive power and proper timing of the movement.

CONCLUSION, RAMIFICATIONS, AND SCOPE

Thus it is seen that my invention provides a timepiece which combines the best features of linear clock displays with those of their digital counterparts, thus improving on the legibility of the digital display and increasing the utility of the linear display. My invention creates a primary timepiece with a simple, legible and clearly contemporary design, employing electronic and mechanical capabilities currently available in such a way that no extraneous information is presented to the user.

While the above description contains many specificities, these should not be construed as limitations on the scope of the invention, but rather as an exemplification of one preferred embodiment thereof. Many variations on the invention are possible, as mentioned in the description above. Further variations are possible: right-hand station 30 could be eliminated with no loss of information; the line of lamps 80 (FIG. 3) could be curved, instead of straight; the entire clock face 10 could be contained in a liquid-crystal display, etc. Accordingly the scope of the invention should be determined not by the embodiments illustrated, but by the appended claims and their legal equivalents.

I claim:

1. A clock, comprising a display face and control means for controlling said display face, said display face comprising:

(A) a first display station comprising a window arranged to display a discrete, digital number which is always centered in said window and which indicates the number of major time intervals which have elapsed from a predetermined starting time, and (B) a series of discrete substations spaced apart from each other evenly in a line and which extends from said first display station, each substation representative of a minor time interval which is a division of said major time interval, successive substations along said line indicating successively cumulative minor time intervals, a sufficient number of said substations being provided to cumulatively indicate at least said major time interval less one minor time interval, said control means being arranged to (1) cause said first display station continuously to display a succession of digital numbers indicative of the number of major time intervals which have elapsed from said predetermined starting time up to a given maximum number of said major time intervals and then reset and repeat such continuous display of said succession of digital numbers, (2) cause each displayed digital number at said first display station to switch abruptly to each next succeeding displayed digital number at each major time interval so that only one digital number is unambiguously displayed at any time, (3) cause successive ones of said series of discrete substations to be sequentially activated at said minor time intervals so that said series of substations will continuously, precisely, and unambiguously indicate the number of minor time intervals which have elapsed from the time indicated by said first display station, and (4) cause each sequential substation to be abruptly activated at one minor time interval after its preceding substation has been activated.

2. The clock of claim 1 wherein said first display station and said substations are arranged in a straight line.

3. The clock of claim 1, further including a second display station capable of displaying the number of said major time intervals displayed by said first display station plus one, except when said first display station indicates said given maximum number of said major time intervals, said second display station being positioned on said line after the last of said substations from said first display station, such that said line of substations extends between said first and second display stations.

4. The clock of claim 3 wherein said stations and said substations are arranged in a straight line.

5. The clock of claim 1 wherein said major time intervals are hours.

6. The clock of claim 3 wherein said minor time intervals are twelfths of an hour.

7. The clock of claim 3 wherein said minor time intervals are minutes or sixtieths of an hour.

8. The clock of claim 1 wherein said first display station displays a digital Arabic number and said substations each comprise a binary indicator.

9. The clock of claim 8 wherein said means comprises an electronic circuit and said first display station and each of said substations are electronically-driven light emitters.

10. The clock of claim 8 wherein said means comprises a mechanical mechanism and said station and said substation are mechanically-driven indicators.

11. The clock of claim 8 wherein each of said substations is a light emitter capable of emitting either of a plurality of colors, a first of said colors representing the beginning of one of said minor intervals, a second of said colors representing a predetermined subminor interval smaller than said minor interval, said means being arranged to activate said substations so that the appropriate one emits said first color at the beginning of its minor interval and said second color at the beginning of a subminor interval thereafter.

12. The clock of claim 11 wherein each of said substations is capable of emitting either of said plurality of colors or both of said colors together to provide a third color such that said light emitter can emit any one of three different colors, said first of said colors representing the beginning of one of said minor intervals, said second of said colors representing a predetermined subminor interval smaller than said minor interval, and said third color representing another predetermined subminor interval smaller than said minor interval, said means being arranged to activate said substations so that the appropriate one emits said first color at the beginning of its minor interval, and said second and third colors at the beginning of their respective subminor intervals thereafter.

13. The clock of claim 1 wherein said means activates said substations such that each activated substation will remain activated when its subsequent substation is activated until said minor time interval elapses after all of said substations are activated.

14. The clock of claim 1 wherein said means activates said substations such that each activated substation will become unactivated when its subsequent substation is activated.

15. A clock, comprising:

a display face having:

(A) a first display station capable of displaying a digital number indicative of the number of major time intervals which have elapsed from a predetermined starting time, (B) a series of substations spaced evenly in a line and extending from said first display station, each representative of a minor time interval which is a subdivision of said major time interval, successive substations along said line indicating successively cumulative minor time intervals, a sufficient number of said substations being provided to cumulatively indicate at least said major time interval less one minor time interval, and (C) a second display station capable of displaying a digital number indicative of the number of major time intervals which have elapsed from a predetermined starting time, plus one major time interval, said second display station being positioned on said line after the last of said substations from said first display station, such that said line of substations extends between said first and second display station, said clock also having:

(D) means for (1) causing said first display station continuously to indicate the number of major time intervals which have elapsed from said predetermined starting time, (2) sequentially activating successive ones of said series of substations at said minor time intervals so that said series of substations will continuously indicate the number of minor time intervals which have elapsed from the time indicated by said first display station, and (3) causing said second display station continuously to indicate the number of major time intervals which have elapsed from said predetermined starting time, plus one major time interval.

16. The clock of claim 15 wherein said means activates said substations such that each activated substation will remain activated when its subsequent substation is activated until said minor time interval elapses after all of said substations are activated.

17. The clock of claim 15 wherein said means activates said substations such that each activated substation will become unactivated when its subsequent substation is activated.

18. The clock of claim 15 wherein said station displays two digital Arabic numbers and said substations each comprise a binary indicator.

19. The clock of claim 18 wherein said means comprises a mechanical mechanism and said station and said substation are mechanically-driven indicators.

20. The clock of claim 18 wherein said means comprises an electronic circuit and said station and each of said substations are electronically-driven light emitters.

* * * * *